United States Patent [19]

Baucom

[11] 4,298,293

[45] Nov. 3, 1981

[54] CURB FORMING APPARATUS

[76] Inventor: Charlie J. Baucom, Rte. 2, Box 121, Webbers Falls, Okla. 74470

[21] Appl. No.: 82,311

[22] Filed: Oct. 5, 1979

[51] Int. Cl.[3] ..... E01C 11/28

[52] U.S. Cl. ..... 404/98

[58] Field of Search ..... 404/98, 83, 96

[56] References Cited

U.S. PATENT DOCUMENTS

| | | | |
|---|---|---|---|
| 1,018,780 | 2/1912 | Rauschenbach | 404/98 |
| 1,985,220 | 12/1934 | Clark | 404/98 |
| 3,108,518 | 10/1963 | O'Connor | 404/98 |
| 3,208,362 | 9/1965 | Sigmund | 404/98 |
| 3,472,134 | 10/1969 | Wilbur | 404/98 |
| 3,820,913 | 6/1974 | Miller | 404/98 |
| 3,954,359 | 5/1976 | Larkin | 404/98 X |
| 4,027,990 | 6/1977 | Merrill | 404/98 |

*Primary Examiner*—Nile C. Byers, Jr.

*Attorney, Agent, or Firm*—Head & Johnson

[57] ABSTRACT

A curb forming apparatus for traveling along a single horizontal longitudinal form adjacent a side edge of a pavement comprising, in combination, a frame with a plurality of aligned wheels for traveling upon said form, a curb forming chute mounted within said frame and being adapted to slide along said pavement, a hopper mounted to said frame and in communication with said chute, a skid plate attached to said frame and being adapted to slide upon said pavement, and a propulsion means to propel said apparatus along said form.

10 Claims, 4 Drawing Figures

CURB FORMING APPARATUS

BACKGROUND OF THE INVENTION

1. Field of the Invention

The present invention relates to a curb forming apparatus and, more particularly, to such an apparatus which travels along a single horizontal longitudinal form and pavement surface.

2. Description of the Prior Art

Numerous concrete and asphalt handling machines have been developed over the years to lay a continuous stretch of curbing. These prior art machines are usually large self-propelled units which travel across the surface of an already-laid pavement. These units are impractical for use on smaller operations, therefore, numerous smaller machines have been developed. Oftentimes, however, a municipal ordinance or statute mandates that immediately after a pavement has been laid and while still wet, the curbing should be laid thereon. These prior art machines are incapable of forming a curb on a still wet pavement without destroying the surface of the pavement. Also, these prior art machines usually require the use of "zero-slump" or "one inch-slump" concrete mix to operate efficiently. This concrete mix cures very rapidly and is hard to work when finsihing.

Other curb forming machines have been developed to ride along two parallel strings of forms. These machines are used to lay a curb before a pavement has been laid. These machines may not be used if the municipality has an ordinance or statute of the type noted above. Further, the operation of these machines is time consuming in that two strings of forms have to be laid and disassembled.

SUMMARY OF THE INVENTION

The present invention generally provides a curb forming apparatus which travels along a single horizontal longitudinal form and pavement surface. The curb forming apparatus is small, lightweight and easily operated by a single individual. The apparatus is designed to lay a curb upon a still wet pavement without destroying the non-hardened surface thereof. Further, this apparatus is capable of using "one-inch slump" to "three-inch slump" concrete mix, thereby allowing greater workability and finishability of the curb.

The present invention, more particularly, comprises a frame having a front, rear and a first and second side members. A plurality of aligned wheels are mounted to the first side member for traveling upon the single horizontal form. A curb forming chute is mounted within the frame adjacent the first side member and is adapted to slide against the form and the pavement. A hopper is mounted to the frame above the chute and is provided with an opening in the lower portion thereof which is in communication with the chute. A skid plate is attached to a second of the side members and is adapted to slide along the surface of the pavement. An electric or internal combustion engine is provided to propel the apparatus along the form.

The lower portion of the chute is removable and different configured lower portions are attachable to this chute to form different curb designs. The hopper and the skid plate provided with devices to universally adjust the level thereof.

DETAILED DESCRIPTION OF THE PREFERRED EMBODIMENT

Figure 1:
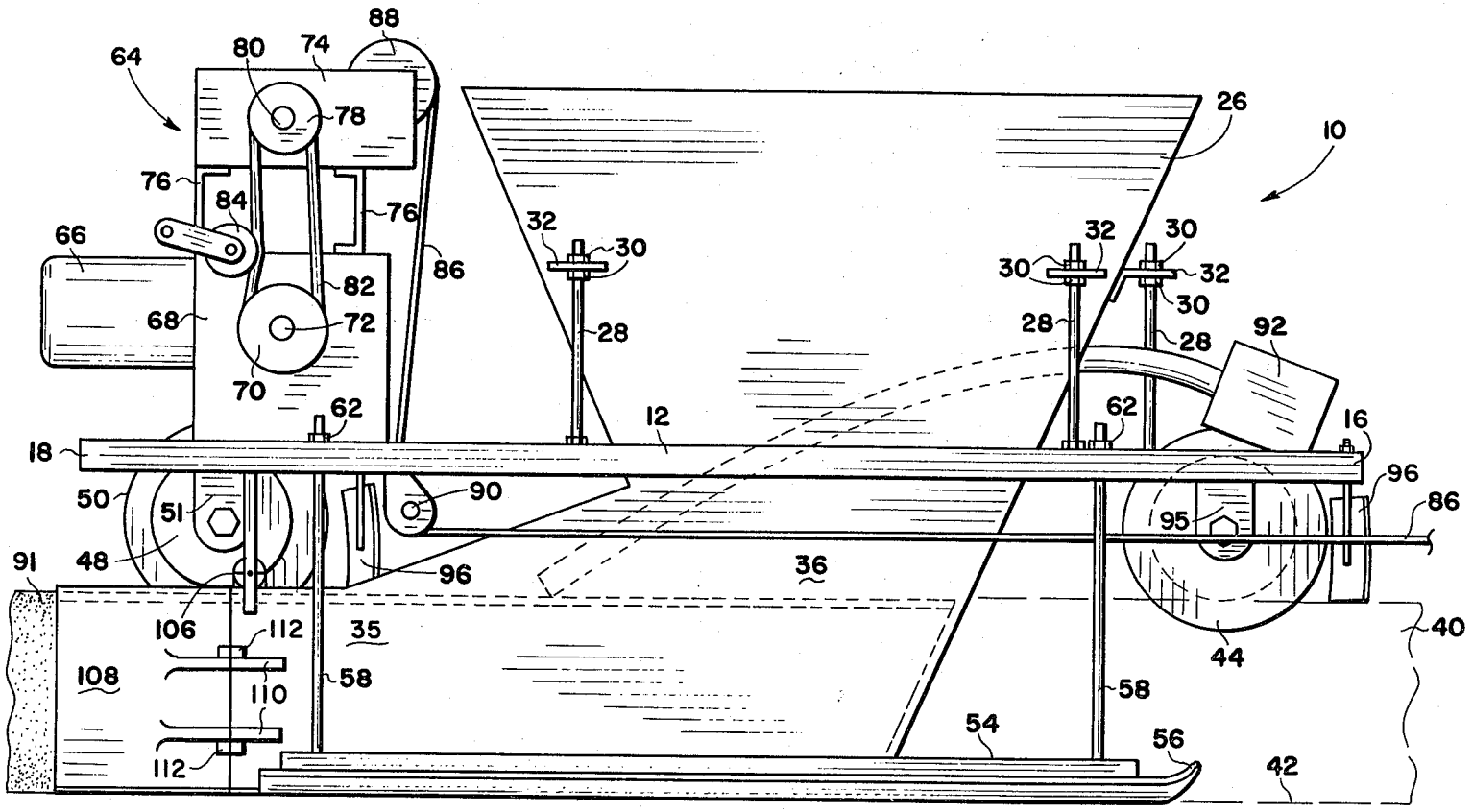
FIG. 1 is a right side elevational view of a curb forming apparatus embodying the present invention.
Figure 2:
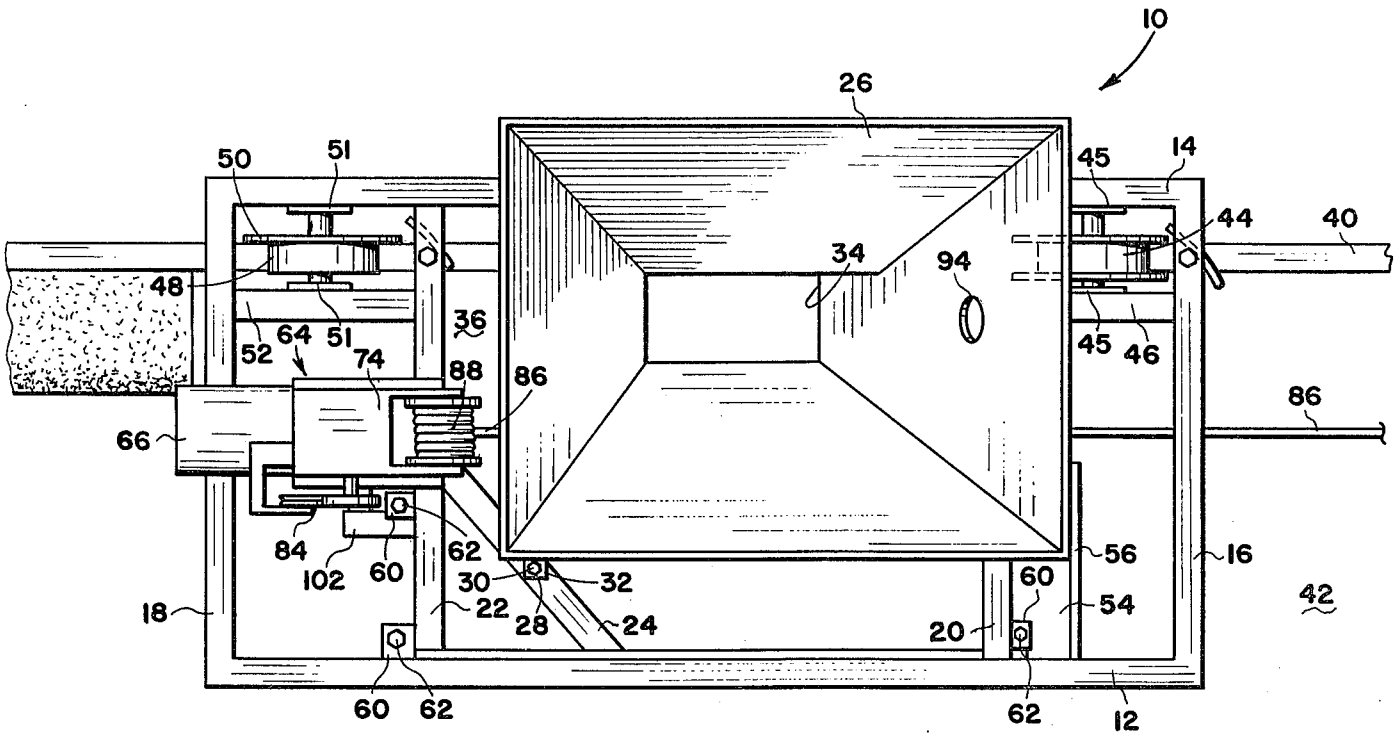
FIG. 2 is a top plan view of the apparatus.

Referring to the drawings in detail, reference character 10 generally indicates a curb forming apparatus particularly designed to lay a continuous length of curb on top of a street pavement or other similar pavement. As shown in FIGS. 1 and 2, the curb forming apparatus 10 is formed by a rectangular frame having a right hand side member 12, a left hand side member 14, a front member 16, and a rear member 18. A first brace 20 is spaced between the right member 12 and left member 14 and adjacent the front member 16. A second brace 22 is spaced between the right member 12 and the left member 14 adjacent the rear member 18. A short diagonal brace 24 extends from the center of the second brace 22 to the right member 12.

Figure 3:
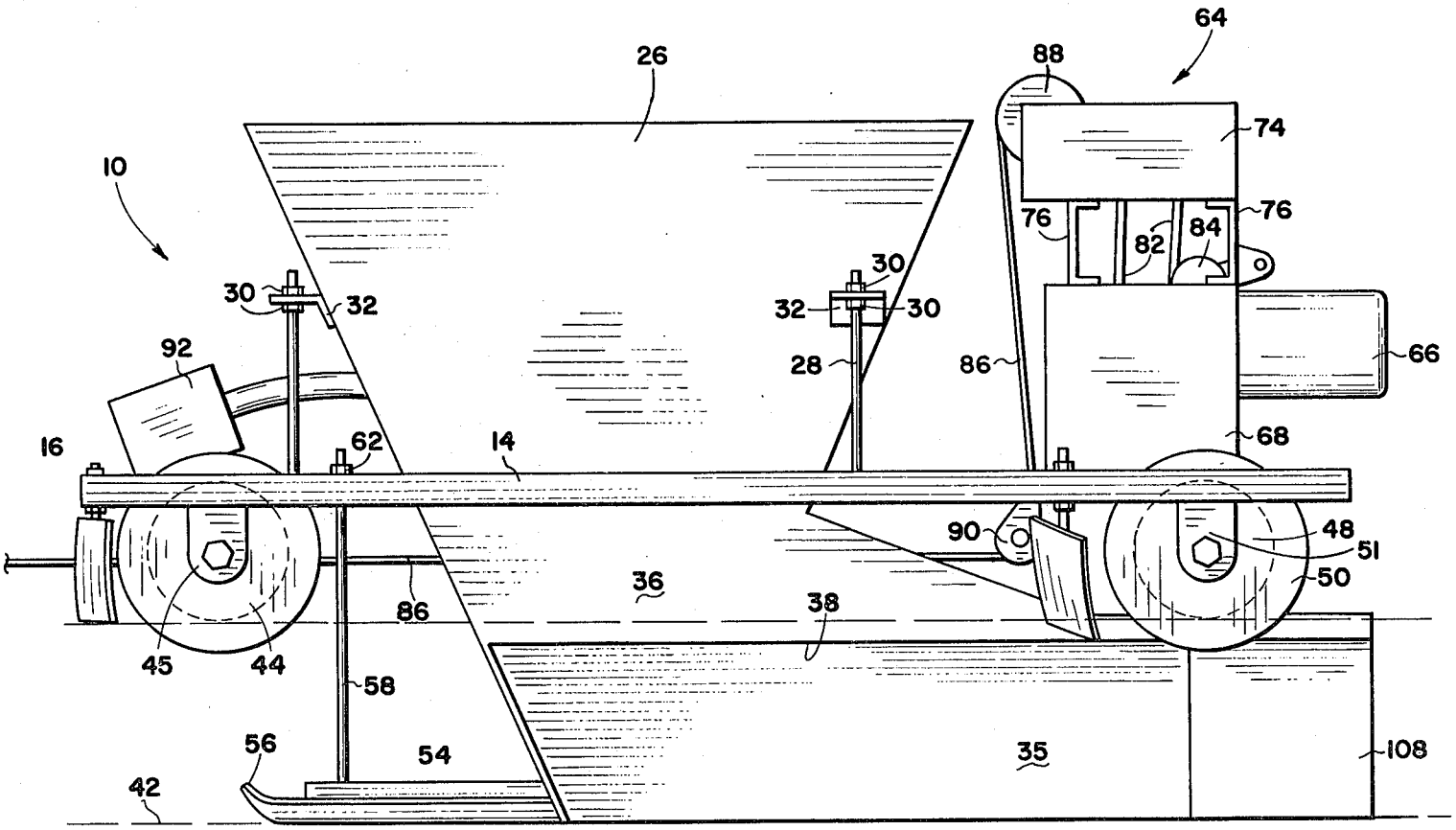
FIG. 3 is a left side elevational view of the apparatus.
Figure 4:
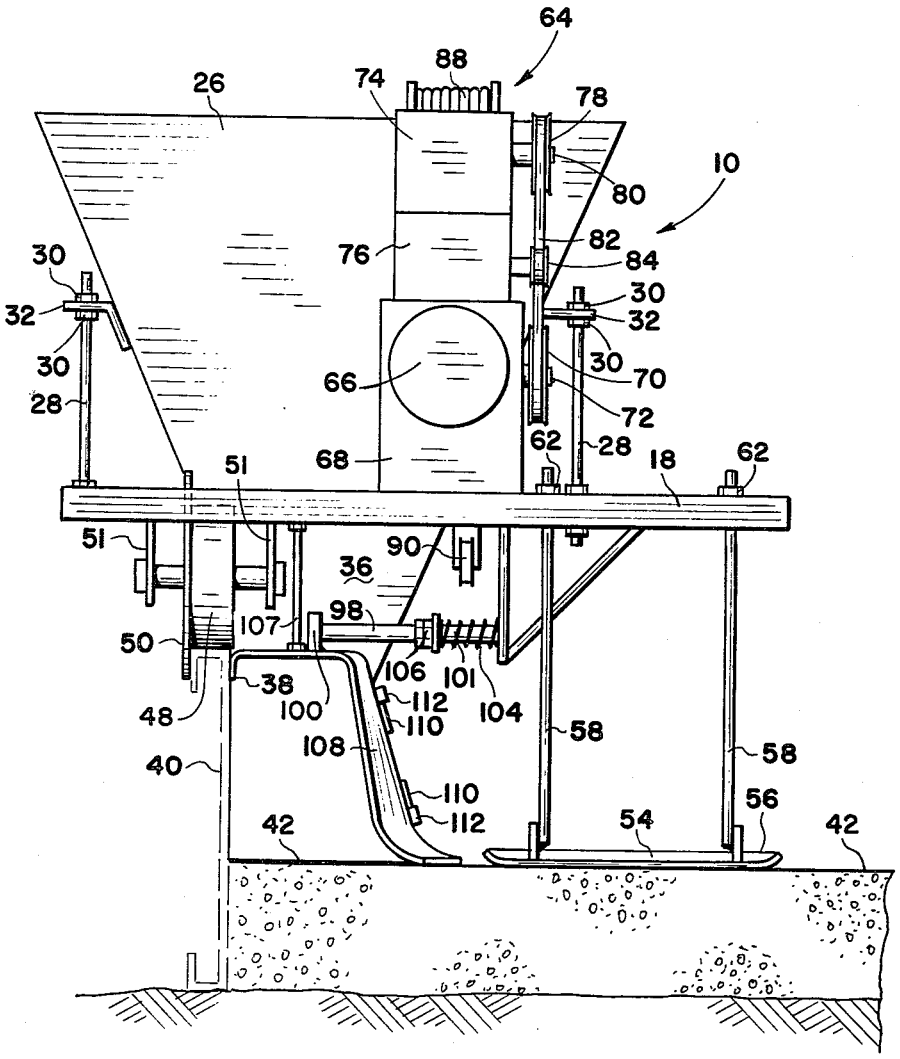
FIG. 4 is a rear elevational view of the apparatus.

A material handling hopper 26 is attached to the braces 20 and 24 and the left member 14 by means of elongated bolts 28, with nuts 30 threaded to the top thereto, which pass through a plurality of brackets 32, which are attached to the sides of the hopper 26. As shown in FIG. 2, an opening 34 is spaced in the lower portion of the hopper 26. Attached to and below the hopper 26 is an elongated curb forming chute 36, which is in communication with the opening 34 in the hopper 26 and which extends towards the rear of the apparatus 10. As shown in FIG. 3, an elongated lower portion 35 of the chute 36 on the left side thereof, is cut away to form an opening 38. As best seen in FIG. 4, the apparatus 10 is designed to move along a pavement edge form 40 which rises a short distance above the level of the surface of a pavement 42 with the lower portion 35 of the chute 36 abutting against the form 40. A double flanged wheel 44 is pivotally mounted between a pair of brackets 45 which extend downward from the left member 14 and a short parallel front brace 46, which is spaced between the front member 16 and the first brace 20. The wheel 44 is adapted to travel along the top edge of the form 40. A wheel 48 with a single flange 50 on the outside edge thereof, is pivotally mounted between a pair of brackets 51 which extend downward from a short parallel rear brace 52, which is spaced between the rear member 18 in the second brace 22 and the left member 14. The wheel 48 is adapted to travel along the top edge of the form 40.

A rectangular horizontal plate or skid 54, with a raised front lip 56, is attached to the apparatus 10 and is adapted to slide along the surface of the pavement 42. The skid 54 is attached to the apparatus 10 by means of a plurality of vertical elongated bolts 58 which extend upwardly from the approximate corners of the skid 54 through a plurality of brackets 60, which are attached to the first and second braces 20 and 22 and are secured thereto by means of a plurality of nuts 62.

The apparatus 10 is drawn across the surface of the pavement 42 by a powered winch means 64. The winch means 64 is comprised of an electrical motor 66 connected to a right angle drive mechanism (not shown) within a housing 68, which is mounted to the second brace 22 in the rear member 18 approximately along the center line of the apparatus 10. A pulley 70 is attached to a shaft 72, which extends from the right angle drive mechanism. A winch 74 is mounted on top of a plurality of brackets 76, which are in turn mounted to the top surface of the housing 68. A pulley 78 is mounted to the shaft 80 which extends from the winch 74.

A continuous belt 82 is positioned around the pulleys 70 and 78 and transmit power from the motor 66 to the winch 74. A pivotally mounted idler pulley 84 is mounted to one of the brackets 76 and maintains tension on the belt 82. A cable 86 extends from a spool 88, which is mounted within the winch 74, downward through a pulley block 90, which is mounted to the underside of the second brace 22, and extends forwardly therefrom to a fixed object (not shown) a certain distance along the form 40. When the motor 66 is connected to a source of electrical power (not shown), the winch 74 rewinds the cable 86 thereby propelling the apparatus 10 forwardly along the form 40 and pavement 42. An internal combustion engine may be used in place of the electric motor 66, and then the idler pulley 84 would provide a clutch means for the winch 74.

To make a run of curbing, the apparatus 10 is placed on top of the still wet pavement 42 with the wheels 44 and 48 engaging the top edge of the form 40. The cable 86 is unwound from the winch 74 and is extended, usually 150' and attached to a stationary object, such as a post or the like, along the form 40. The motor 66 is connected to a source of electrical power, such as a small electrical generating unit carried within a vehicle (not shown) which travels alongside the pavement 42. Concrete mix (not shown) is poured into the hopper 26 and flows into the chute 36 to the opening 38. As the apparatus 10 is moving forward the weight of the concrete within the hopper 26 causes concrete to be extruded from the chute 36 in the shape of a curb 91. As can be seen in FIG. 2, the majority of the weight of the apparatus 10 is placed on the wheels 44 and 48 thereby allowing the skid 54 to slide along the surface of the pavement 42 without grooving or destroying the surface thereof.

A majority of the prior art curb formig apparatuses require the use of 0" to 1" slump concrete mix. This concrete mixture cures very quickly and is hard to finish in the event that there are any gaps or depressions that need to be smoothed over. The apparatus 10 works equally well with 0" to 3" slump concrete mix. The use of 3" slump mix is desired for its easy workability and finishability as we as that it flows more easily from the hopper 26 through the chute 36.

A concrete vibrator 92 extends through an opening 94 in the front portion of the hopper 26. The vibrator 92 may either be powered by a small internal combustion motor or by an electric motor, which is to be connected to the same source of electrical power as the winch motor 66. The vibrator 92 provides a roddening action to the concrete mix and thereby ensures the continuous flow of the concrete mix from the hopper 26 through the chute 36 and through the opening 38.

Oftentimes, when the pavement 42 is laid gravel, dirt and concrete may be deposited upon the top surface of the form 40. A flexible wiper blade 96 is attached to the apparatus 10 in front of each wheels 44 and 48 to clear this debris from the top of the form 40 thereby ensuring the smooth formation of the curb 91. Due to the fact that the form 40 extends above the surface of the pavement 42 at different heights from job to job, the height and tilt angle, either side to side or front to rear, of the hopper 26 and skid 54 are adjustable by means of adjusting the nuts 30 on the elongated bolts 28 for the hopper 26 and adjusting the nuts 62 on the bolts 58 for the skid 54.

To enable the apparatus 10 to properly lay a curb 91 while negotiating a curve in the pavement 42, the rear portion 35 of the chute 36 is yieldably maintained against the form 40 by means of a sliding rod 98, which is attached to a lug 100 extending upwardly from the lower portion of the chute 35. The rod 98 slides over an inner rod 101 with one end of which being mounted to a frame 102, which extends from the underside of the second brace 22. A spring 104 is spaced around the rod 101 and acts upon a collar 106, which is attached to the end of the rod 98, thereby maintaining the rear portion 35 of the chute 36 against the form 40. The apparatus 10 is further provided with a vertical bar 107, which is attached to the underside of the rear member 18 and to the top surface of the lower portion 35 of the chute 36. The bar 107 prevents the lower portion 35 of the chute 36 from flexing upwards. When the apparatus 10 negotiates a right hand curve, the wheel 48 will be slightly displaced to the left on the form 40 and the rear 35 of the chute 36 will be displaced a partial distance to the right compressing the spring 104. When the apparatus 10 negotiates a left hand curve, the rear portion 35 of the chute 36 is maintained in contact with the form 40 by means of the spring 104.

Due to the fact that there are a vast number of different curb shapes, many of which being specifically rerequired by municipal statutes or ordinances, the apparatus 10 is provided with means to attach interchangeable curb forms 108 of different shapes which are connected to the rear portion 35 of the chute 36. Each curb form 108 is provided with a plurality of elongated members 110 which extend a partial distance forward against the side edge of the lower portion 35 of the chute 36. A plurality of clamps 112 connect the form 108 to the chute 36 thereby providing, in combination with the members 110, a rigid connection between the form 108 and the chute 36.

Whereas the present invention has been described in particular relation to the drawings attached hereto, it should be understood that other and further modifications of the invention, apart from those shown or suggested herein, may be made within the scope and spirit of this invention.

What is claimed:

1. A curb forming apparatus for traveling along a single horizontal longitudinal form adjacent a side edge of a pavement comprising, in combination:

a frame having a front, rear, a first and second side members;

a plurality of aligned wheel means mounted to said first side member traveling upon said form;

a curb forming chute mounted within said frame adjacent said first side member and a lower portion thereof being adapted to slide against said form and said pavement;

means to bias said chute against said form;

a hopper means mounted to said frame above said chute and being provided with an opening in the lower portion thereof in communication with said chute;

a skid pad attached to said second side member, adapted to slide upon said pavement; and propulsion means operatively related to said frame to propel said apparatus along said form.

2. A curb forming apparatus as in claim 1 wherein said propulsion means is comprised of a powered winch means secured to said frame and cable means extending therefrom to engage a stationary object a certain distance along said form whereby said winch means pull said cable to cause said apparatus to move along said form.

3. A curb forming apparatus as in claim 2 wherein said powered winch means is powered by an electric motor in communication with a source of electrical power.

4. A curb forming apparatus as in claim 2 wherein said powered winch means is powered by an internal combustion engine.

5. A curb forming apparatus as in claim 1 wherein one of said wheel means being provided with flanges on either side thereof engageable with said form and a second of said wheel means being provided with a single flange engageable with said form.

6. A curb forming apparatus as in claim 1 wherein said means to bias said chute is a horizontal spring means attached at one end to said chute and at a second end to said frame, whereby said chute is yieldably maintained against said form.

7. A curb forming apparatus as in claim 1 wherein said chute is provided with a removable curb design form and different forms being attachable to said chute to form different curb designs.

8. A curb forming apparatus as in claim 1 wherein vibrator means is provided within said hopper.

9. A curb forming apparatus as in claim 1 wherein said hopper and chute being provided with means to adjust the levels thereof.

10. A curb forming apparatus as set forth in claim 1 wherein said skid plate being provided with means to adjust the level thereof.

* * * * *